US007711289B2

(12) United States Patent
Kato

(10) Patent No.: US 7,711,289 B2
(45) Date of Patent: May 4, 2010

(54) ROTATION MEMBER DRIVING APPARATUS, PHOTOCONDUCTIVE MEMBER UNIT, AND IMAGE FORMING APPARATUS

(75) Inventor: Masahiko Kato, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 362 days.

(21) Appl. No.: 11/762,560

(22) Filed: Jun. 13, 2007

(65) Prior Publication Data

US 2007/0292160 A1 Dec. 20, 2007

(30) Foreign Application Priority Data

Jun. 16, 2006 (JP) ..... 2006-167608

(51) Int. Cl.
*G03G 15/00* (2006.01)

(52) U.S. Cl. ..... 399/167

(58) Field of Classification Search ..... 399/111, 399/116, 117, 167
See application file for complete search history.

(56) References Cited

U.S. PATENT DOCUMENTS 5,357,231 A * 10/1994 Miwa et al. ..... 399/36

FOREIGN PATENT DOCUMENTS

| | | |
|---|---|---|
| JP | 09-222826 | 8/1997 |
| JP | 11-095612 | 4/1999 |
| JP | 2001-134139 | 5/2001 |
| JP | 2001-188438 | 7/2001 |

* cited by examiner

*Primary Examiner*—Hoang Ngo
(74) *Attorney, Agent, or Firm*—Harness, Dickey & Pierce, P.L.C.

(57) ABSTRACT

A rotation member driving apparatus for driving a printing member includes a printing member shaft attached to the printing member, a driving motor that drives the printing member, and a driving motor shaft attached to the driving motor. A first gear is attached to the driving motor shaft. A drive transmission gear is provided to transmit driving force of the driving motor to the printing member shaft from the first gear. An inertia member is arranged on the same axis as the driving motor.

7 Claims, 5 Drawing Sheets

ROTATION MEMBER DRIVING APPARATUS, PHOTOCONDUCTIVE MEMBER UNIT, AND IMAGE FORMING APPARATUS

CROSS REFERENCE TO RELATED APPLICATION

This application claims priority under 35 USC §119 to Japanese Patent Application No. 2006-167608, filed on Jun. 16, 2006, the entire contents of which are herein incorporated by reference.

BACKGROUND OF THE INVENTION

1. Field of the Invention

The present invention relates to an rotation driving apparatus employed in an electro-photograph type image forming apparatus, such as a laser printer, a copier, a facsimile, etc., and a photo-conductive member unit including the rotation driving apparatus, and an image formation system including the photo-conductive member unit.

2. Discussion of the Background Art

The Japanese Patent Application Laid Open No. 11-095612 discusses a technology in that a driving gear for driving a photo-conductive member is linked with a flywheel via a protrusion of an elastic member, and a rigidity K and a damping performance of twisting vibration are determined by the protrusion so that a gain of a transmission performance and a change in speed decrease.

The Japanese Patent Application Laid Open No. 9-222826 also discusses a technology in that an inertia morality of an inertia member, a number of rotations of a gear, and a number of gear teeth of the gear each included in a rotation driving system are determined so that frequencies of a change in speed, which is caused by gear meshing, and an eccentricity of a rotation driving apparatus, which is formed from gears, can fall within a damping range in a frequency response of the rotation driving apparatus.

Accordingly, such a technology is capable of suppressing amplification of vibration in the apparatus.

As factors limiting a high quality electro-photograph, so-called jitter and banding are exemplified. Especially, a positional accuracy of laser writing per line is highly demanded as an image quality progresses after introduction of a digital technology. One of factors controlling the image quality, a change in speed of a photoconductive member drum, which is caused by torsional vibration of a rotation driving system, is exemplified. Accordingly, reduction of such torsional vibration is important in the rotation driving system in developing a product capable of creating a high quality image.

As a relation between a visible sensitivity and a space frequency of an image, it is generally known that a visible space frequency of from about 0.3 line/mm to about 2 line/mm can be readily sensed in light of a sense of human vision.

Then, when considering such a relation together with a rotational speed of the photoconductive member, it is understood that vibration in a frequency region of from about few Hz to about several hundred Hz necessarily is avoided.

SUMMARY OF THE INVENTION

The present invention has been made in view of the above noted and another problems and one object of the present invention is to provide a new and noble driving apparatus for driving a photoconductive member. Such a new and noble driving apparatus includes a photoconductive member shaft attached to the photoconductive member, a driving motor that drives the photoconductive member, and a driving motor shaft attached to the driving motor. A first gear is attached to the driving motor shaft. A drive transmission gear is provided to transmit driving force of the driving motor to the photoconductive member shaft from the first gear. An inertia member is arranged on the same axis as the driving motor.

In another embodiment, a driving apparatus for driving a photo-conductive member comprises a photo-conductive member shaft attached to the photoconductive member, a driving motor configured to drive the photoconductive member, and a driving motor shaft attached to the driving motor.

A first gear is attached to the driving motor shaft. A drive transmission gear is provided to transmit driving force of the driving motor to the photoconductive member shaft from the first gear. A second gear is provided to distribute the driving force of the first gear. A diameter of the second gear is smaller than that of the first gear. An inertia member is arranged on the same axis as the second gear.

In yet another embodiment, the first gear includes two steps of gears having a different diameter form the other.

In yet another embodiment, the inertia member is substantially uniform in a circumferential direction.

In yet another embodiment, the inertia member is formed in a disc shape.

In yet another embodiment, the inertia member is made of metal.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
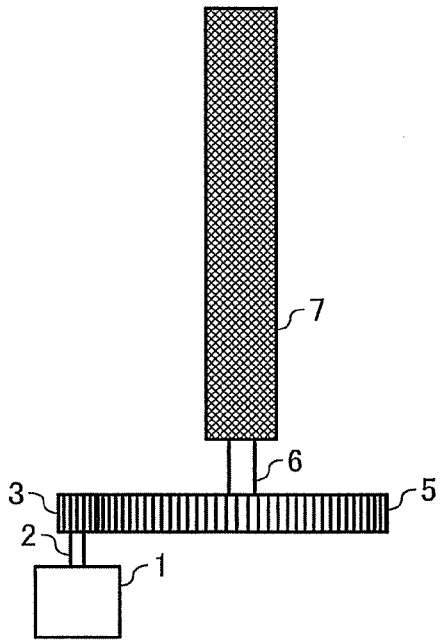
FIG. 1 illustrates a typical rotation member driving apparatus.

Referring now to the drawings, wherein like reference numerals and marks designate identical or corresponding parts throughout several figures, in particular in FIG. 1, a typical rotation driving system (e.g. a rotation member driving apparatus) of an image forming apparatus is described.

As shown, a rotation driving system includes a driving motor 1, a driving motor shaft 2, and a first gear 3 attached to the driving motor shaft 2. Also included in the rotation driving system is a driving force transmission gear 5 that transmits a driving force from the first gear 3 to a photoconductive member 7 via a photoconductive member shaft 6.

The rotation driving system shows various rotation system vibration modes. As a vibration mode most highly provably affecting an image is a torsional vibration mode of a photoconductive drum or the like, which is generally caused when a photoconductive member driving shaft and a drum flange are intervened. Such a vibration mode amplifies an excitation force created in a driving force transmission system, and changes a speed of the photoconductive member.

The change in speed then deteriorates an image during image formation.

Figure 2:
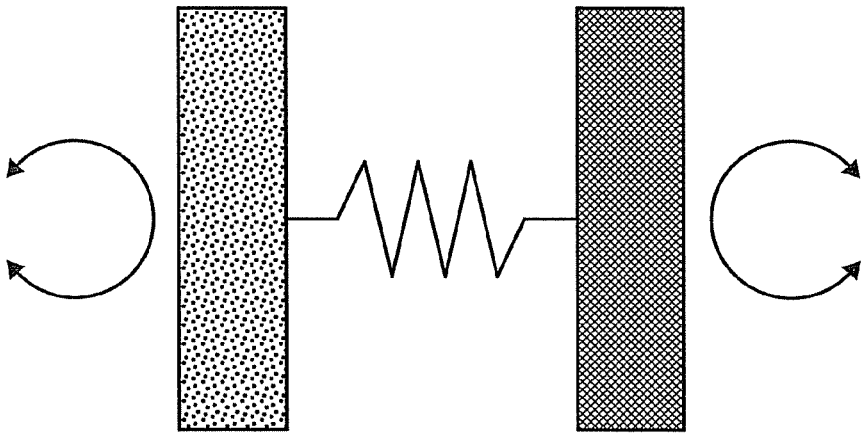
FIG. 2 illustrates a configuration of the rotation member driving apparatus.

As shown in FIG. 2, the rotation driving system of FIG. 1 can be converted into a two-inertia unit system as a simple vibration model that includes a spring and two inertia units. These two inertia units include a combination of the driving motor 1 and the driving force transmission gears 3 and 5, and the photoconductive member 7, respectively.

Torsional rigidity of a connection section connecting a shaft to a flange of the photoconductive member or the like is regarded as a spring. Functions of these inertia members can be analyzed using a dynamic equation.

Specifically, when respective inertia and torsional rigidity parameters are given, a change in speed of a photoconductive member in relation to an input torque from a motor can be analyzed.

Figure 3:
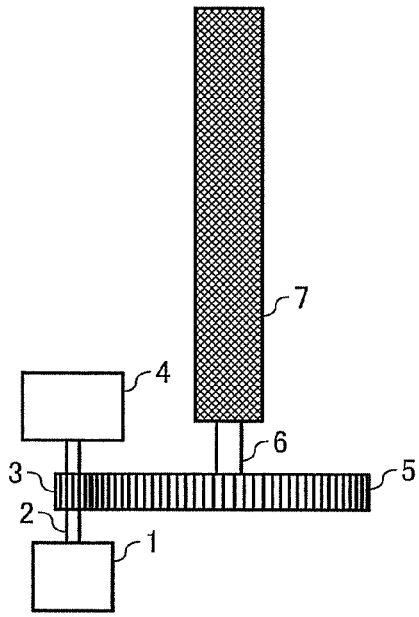
FIG. 3 illustrates a configuration of a second exemplary rotation member driving apparatus.
Figure 4:
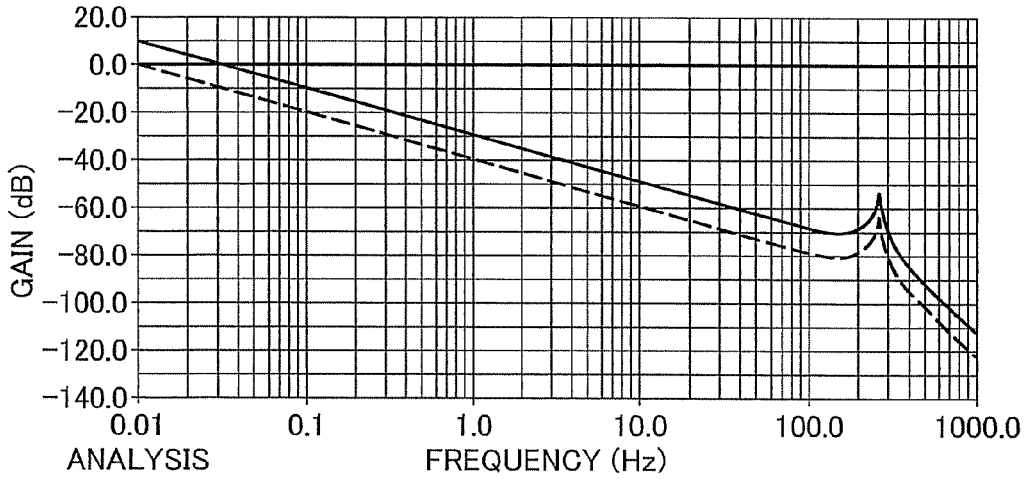
FIG. 4 is a chart illustrating an exemplary result of comparison between a transmission performance of a photo-conductive member surface speed in relation to a drive motor torque in the rotation member driving apparatus without an inertia member and that with the inertia member.

FIG. 4 illustrates an exemplary comparison between a transmission performance of a surface speed of the photoconductive member in relation to a driving motor torque obtained in a photo-conductive member driving apparatus when a photo-conductive member inertia is 461 $kgmm^2$, a drive gear inertia is 1.5 $kgmm^2$, a motor inertia is 110 $kgmm^2$, and a shaft torsional rigidity is 23000 Nmm/deg and that obtained in a photo-conductive member driving apparatus with an inertia member 4 having inertia of about 100 $kgmm^2$ on the same extension axis as the drive motor shaft as shown in FIG. 3.

In the drawing, a rigid line represents a performance obtained without an inertia member, while a dotted line represents that obtained with the inertia member.

As understood from the comparison, the performance with the inertia 4 is lower than that without the inertia member by about 10 dB in an analysis region of less than 1000 Hz.

Thus, when the inertia member is added, influence of a change in torque of a motor itself to a change in speed of a photoconductive member is suppressed, and accordingly, driving accuracy can be increased.

Further, since a vibration transmission level also decreases at around a peak of torsion resonance of 255 Hz, influence of the resonance can be decreased. Accordingly, a driving system can be highly accurate.

According to the first embodiment of the present invention, when an inertia member is arranged on the same axis as the driving motor in a rotation driving apparatus, which employs a driving motor, a first gear arranged on the same axis as the driving motor, a photo-conductive member, a photo-conductive member shaft, and a driving force transmission gear that transmits driving force from the first gear to the photo-conductive member shaft, a gain of a transmission performance of a change in surface speed of the photoconductive member decreases when a driving motor torque is applied.

As a result, influence of a component of a change in speed of a motor to a change in surface speed of the photoconductive member decreases, and accordingly, a high quality image can be obtained.

Figure 5:
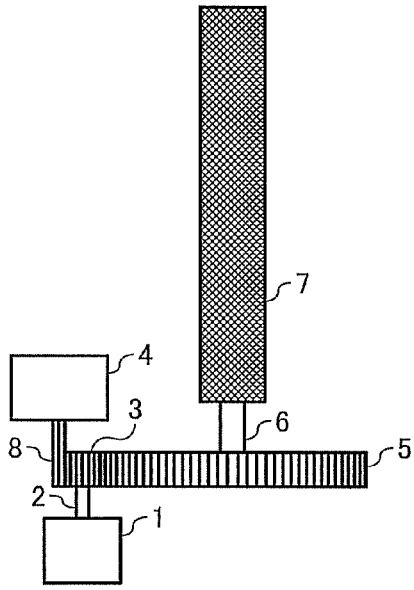
FIG. 5 illustrates a configuration of a second exemplary rotation member driving apparatus.

Now, a second embodiment of the present invention is described with reference to FIG. 5.

As shown, beside the driving force transmission gear 5 that transmits a driving force to the photo-conductive member shaft 6, a second gear 8 with a smaller radius than that of the first gear 3 is provided so as to distribute the driving force of the first gear 3. An inertia member 4 is arranged on the same axis as the second gear 8.

Due to such a configuration, inertia is created in proportion to a square of a ratio between numbers of rotations of both gears due to a gear deceleration ratio, and is larger than that obtained when the same inertia member 4 is added to the first gear 3 as shown in FIG. 3 of the first embodiment.

Figure 6:
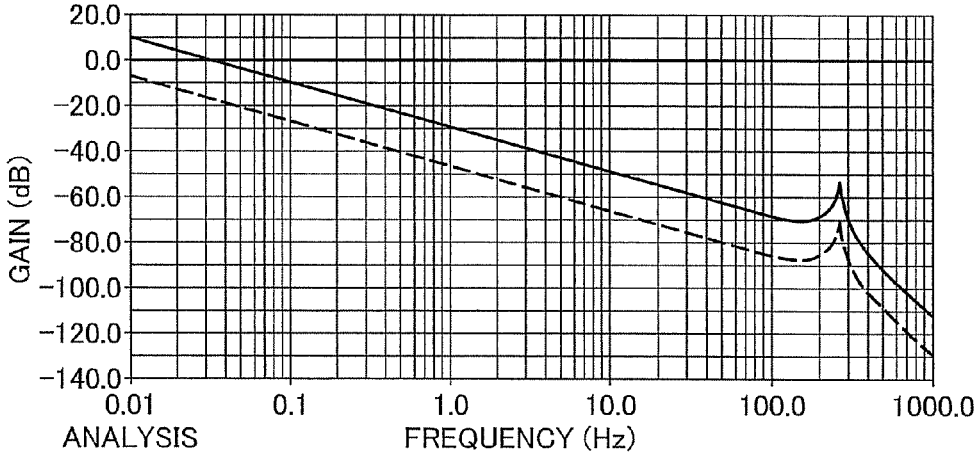
FIG. 6 is a chart illustrating an exemplary comparison between a transmission performance without an inertia member and that in which ratio of gear between the first and second gears is 3 versus 1.

In FIG. 6, an exemplary comparison between a transmission performance obtained without an inertia and that obtained when a ratio between the first and second gears is three versus one. As shown, it is understood that a transmission performance is lower by about 16 dB when the inertia member 4 is added to the same axis as the second gear 8. If a gear ratio is adjusted in this way, even a smaller inertia member is enough to obtain a prescribed damping performance.

According to the second embodiment, since the second gear 8 with the smaller radius than that of the first gear 3 distributes the driving force of the first gear 3, and the inertia member 4 is provided on the same axis of the second gear 4 beside a driving force transmission gear 5 for transmitting a driving force to the photo-conductive member shaft 6, the same result can be obtained as when the inertia member 4 is arranged on the same axis of the first gear 3 even if the morality of the inertia member is small. This is because, inertia is created in proportion to a duplicate of a deceleration ratio. Further, the system can de downsized at low cost.

Figure 7:
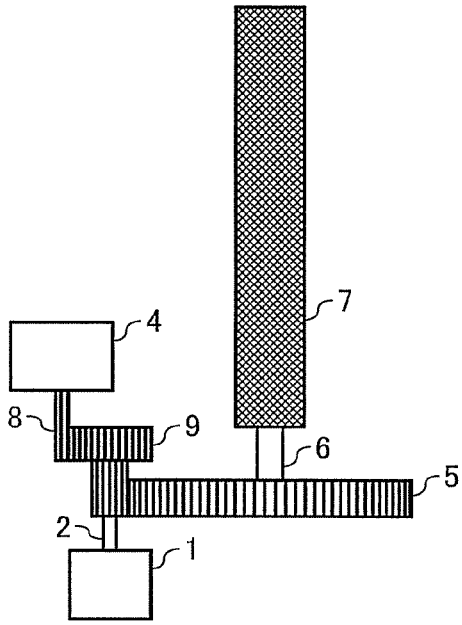
FIG. 7 illustrates a configuration of a third exemplary rotation member driving apparatus.

Now, an exemplary configuration of the third embodiment according to the present invention is described with reference to FIG. 7.

As shown, the first gear 9 is formed in two shapes with different diameters. By employing such a configuration in a first gear 9, a deceleration ratio required in either driving the photoconductive member 7 or rotating the second gear 8 can be optionally designed.

According to the third embodiment, a deceleration ratio required in driving the photoconductive member 7 and that in rotating the second gear can be optionally designed by using the first gear 9 in two shapes with different diameters.

Figure 8:
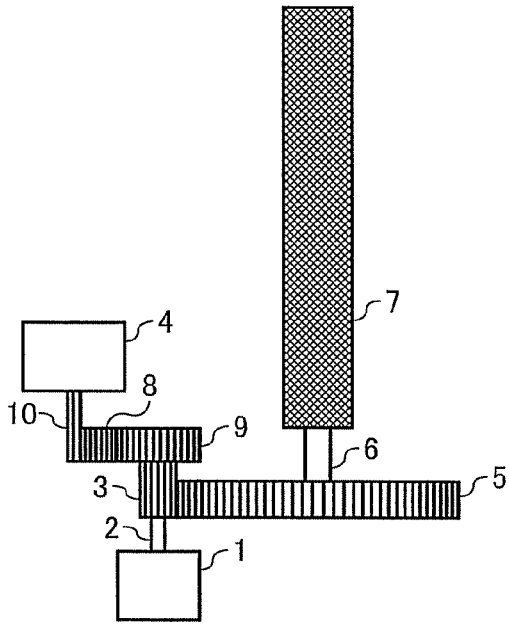
FIG. 8 illustrates a configuration of a third exemplary rotation member driving apparatus.

An exemplary rotation driving apparatus of the fourth embodiment according to the present invention is described with reference to FIG. 8.

As shown, a third gear 10 additionally meshes with the second gear 8. An inertia member 4 is arranged on the same axis as the third gear 10.

A still larger inertia can be obtained if multiple steps more than three are employed and multiple deceleration ratios are obtained even with the same inertia member 4.

In such a situation, the inertia member 4 can be downsized and is lightweight.

According to the fourth embodiment as mentioned heretofore, because the third gear 10 further meshed with the second gear 8, and the inertia member 4 is arranged on the same axis of the third gear 10, the larger inertia can be obtained even if the smaller inertia member 4 is used.

Now, the fifth embodiment is described with reference to FIG. 9.

When an inertia member has unevenness, such as a partial hole, in its circumferential direction, a rotation axis becomes eccentric.

The eccentricity changes rotational speed, and thereby surface speed of the photoconductive member increasingly changes.

Figure 9:
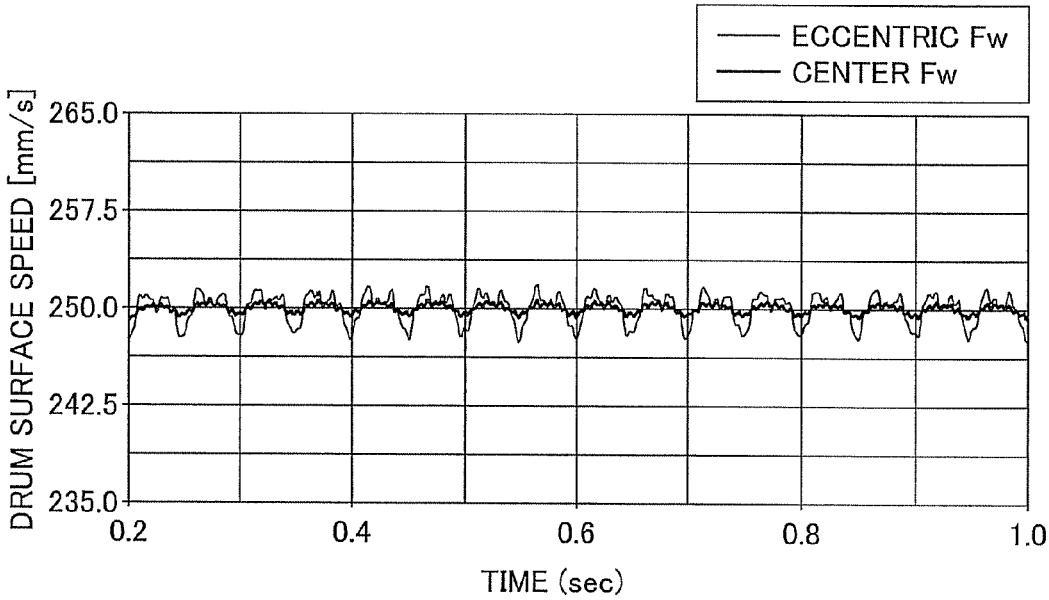
FIG. 9 illustrates a chart illustrating an exemplary result of comparison between a change in photoconductive member speed occurring when there exists inertia distribution and that occurring when there does not exist the inertia distribution.

FIG. 9 illustrates an exemplary comparison of a change in speed of a photoconductive member between a case when a rotation driving apparatus includes an inertia member with such unevenness and that when a rotation driving apparatus includes a uniform inertia member as in the second embodiment.

As there shown, an amplitude of the change is larger when the inertia member having the unevenness in its circumferential direction is employed.

Accordingly, the inertia member preferably excludes unevenness in its circumferential direction.

Thus, the inertia member can be a disc without a deviated rotational center.

When an inertia is not preferably obtained with a single disc, a plurality of discs can be appropriately superimposed to form layers and readily provides a prescribed inertia.

If the inertia member is made of metal having high density, the inertial member can be downsized.

Specifically, the inertia member of the rotation driving apparatus rotates eccentric in a rotation direction and thereby changing the speed when including unevenness in the circumferential direction.

Then, according to the fifth embodiment, the unevenness as a second effect caused when an inertia member is employed is excluded from the inertia member in the circumferential direction, and a system capable of suppressing a change in the speed can be obtained.

Further, a uniform inertia member in the circumferential direction can be readily manufactured by forming it in a disc state.

If the disc state inertia member is made of metal plate or the like, cost can be saved.

An amount of inertia can be readily increased if necessary by superimposing inertia members in the disc state.

When the inertia member is made of metal of relatively high density, larger inertia can be obtained even with a compact size, while reducing a space occupied by a driving transmission system.

Now, the sixth embodiment is described.

The sixth embodiment includes a rotation driving apparatus as employed in one of the first to fifth embodiments as a photoconductive member unit.

Thus, a performance of driving system transmission from the driving motor to the photoconductive member can be improved in the same way as mentioned heretofore.

As a result, a photoconductive member unit can suppress a change in surface speed of the photoconductive member.

Now, the seventh embodiment is described.

An image forming apparatus of this embodiment includes the same photoconductive member unit as in the sixth embodiment. Thus, a performance of driving system transmission from the driving motor to the photoconductive member can be improved in the same manner as mentioned earlier, thereby the image forming apparatus is capable of creating a high quality image. Further, the image forming apparatus can include a color image forming function by including a plurality of the same photoconductive member units as in the sixth embodiment. A change in surface speed of the photoconductive member is reduced for each of colors in the same manner as mentioned earlier.

Thus, the image forming apparatus is capable of creating a high quality color image while avoiding color deviation.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A driving apparatus for rotating a printing member, comprising:

a printing member shaft attached to the printing member;

a driving motor configured to drive the printing member;

a driving motor shaft attached to the driving motor;

a first gear attached to the driving motor shaft; and a drive transmission gear configured to transmit driving force of the driving motor to the printing member shaft from the first gear; and an inertia member arranged on the same axis as the driving motor.

2. A driving apparatus for rotating a printing member, comprising:

a printing member shaft attached to the printing member;

a driving motor configured to drive the printing member a driving motor shaft attached to the driving motor;

a first gear attached to the driving motor shaft; and a drive transmission gear configured to transmit driving force of the driving motor to the printing member shaft from the first gear;

a second gear configured to distribute driving force of the first gear, a diameter of said second gear being smaller than that of the first gear; and an inertia member arranged on the same axis as the driving motor.

3. The driving apparatus as claimed in claim 2, wherein said first gear includes two steps of gears having a different diameter form the other.

4. The driving apparatus as claimed in claim 1, wherein said inertia member is uniform in its circumferential direction.

5. The driving apparatus as claimed in claim 4, wherein said inertia member is in a disc shape.

6. The driving apparatus as claimed in claim 5, wherein said inertia member is made of metal.

7. An image forming apparatus comprising a driving apparatus for rotating a printing member, said driving apparatus including:

a printing member shaft attached to the printing member;

a driving motor configured to drive the printing member;

a driving motor shaft attached to the driving motor;

a first gear attached to the driving motor shaft; and a drive transmission gear configured to transmit driving force of the driving motor to the printing member shaft from the first gear; and an inertia member arranged on the same axis as the driving motor.

* * * * *